US008174391B2

(12) United States Patent
Sandler et al.

(10) Patent No.: US 8,174,391 B2
(45) Date of Patent: May 8, 2012

(54) POLARIZED RFID ANTENNA WITH SPATIAL DIVERSITY

(75) Inventors: Robert I. Sandler, Melville, NY (US); Carl DeGiovine, Shirley, NY (US); Mark W. Duron, Patchogue, NY (US); Rehan K. Jaffri, New York, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 645 days.

(21) Appl. No.: 12/326,201

(22) Filed: Dec. 2, 2008

(65) Prior Publication Data

US 2010/0134252 A1 Jun. 3, 2010

(51) Int. Cl.
*G08B 13/14* (2006.01)

(52) U.S. Cl. ..... 340/572.7; 340/10.1; 343/757

(58) Field of Classification Search ..... 340/572.7, 340/10.1; 343/757–766
See application file for complete search history.

(56) References Cited

U.S. PATENT DOCUMENTS

| | | | | |
|---|---|---|---|---|
| 5,929,817 | A * | 7/1999 | Clark | 343/760 |
| 6,456,258 | B1 * | 9/2002 | Bragg et al. | 343/757 |
| 6,646,620 | B1 * | 11/2003 | Bjornholt et al. | 343/762 |
| 7,036,734 | B2 * | 5/2006 | Baker | 343/874 |
| 2007/0037529 | A1 * | 2/2007 | Nagai et al. | 340/10.34 |
| 2009/0079543 | A1 * | 3/2009 | Nonaka et al. | 340/10.1 |

* cited by examiner

*Primary Examiner* — John A Tweel, Jr.
(74) *Attorney, Agent, or Firm* — Bartholomew DiVita; Terri Hughes Smith; Kenneth A. Haas

(57) ABSTRACT

A system, apparatus, and techniques for interrogating a Radio Frequency Identification (RFID) tag are disclosed. The system includes an RFID reader that includes a pivotable polarized antenna for reading a reader/tag link. The antenna moves at a specific frequency over a specific distance resulting in reader/tag links being moved out of a null region of the reader. Advantageously, by pivoting the antenna, the antenna apparatus minimizes signal fading and improves signal quality from tags.

20 Claims, 8 Drawing Sheets

POLARIZED RFID ANTENNA WITH SPATIAL DIVERSITY

TECHNICAL FIELD

This disclosure relates to a Radio Frequency Identification antenna and more particularly, to a polarized Radio Frequency Identification antenna with spatial diversity.

BACKGROUND

A Radio Frequency Identification (RFID) reader is a transmitter/receiver that reads the contents of RFID tags in the vicinity. Also called an "RFID interrogator" the maximum distance between the reader's antenna and the tag vary, depending on application.

Various diversity techniques have been deployed to improve the quality and reliability of reader antennas. For example, spatial diversity has been employed that use multiple antennas, usually with same characteristics, that are physically separated from one another.

Pattern diversity is another technique that has been employed. Pattern diversity typically consists of two or more co-located antennas with different radiation patterns. This type of diversity makes use of directive antennas that are usually physically separated by some distance.

Another technique is polarity diversity which combines pairs of antennas with orthogonal polarizations (i.e., horizontal, vertical, slanted). With polarity diversity, the same information signal is transmitted and received simultaneously or alternately on orthogonally polarized waves.

One limitation of these techniques is that they do not effectively deal with environmental or antenna null zones. In a null zone, an RFID tag cannot be interrogated by the reader as there is no electromagnetic energy within the null zone to excite the coil of the RFID tag. In addition, many of these techniques require the use of multiple antennas. Multiple antennas, however, can present additional problems. For example, multiple antennas in close proximity can couple to one another, thereby creating additional nulls. This is especially problematic in the near field since the coupling between the antennas can be particularly strong.

Accordingly, it would be advantageous to develop an RFID reader that could alleviate the effect of nulls and at the same time provide the benefits of antenna diversity in communicating with tags.

SUMMARY

A system, apparatus, and techniques for interrogating a Radio Frequency Identification (RFID) tag are disclosed. The system includes an RFID reader that includes a pivotable polarized antenna for reading a reader/tag link. The antenna moves at a specific frequency over a specific distance resulting in reader/tag links being moved out of a null region of the reader. Advantageously, by pivoting the antenna, the antenna apparatus minimizes signal fading and improves signal quality from tags.

For example, according to one aspect, an RFID reader includes an antenna pivotable between a first and second position, an RF transmitter for transmitting an RF signal to an RFID tag through the antenna, an RF receiver for receiving the RF signal from the RFID tag through the antenna, and a signal processor for processing the RF signal.

In one embodiment, the antenna pivots at a set rate approximately equal to a read rate of the RFID reader.

The antenna can pivot in at least one of a horizontal, vertical, angular, and circular direction. Preferably, the antenna pivots in response to a change in an energy force. For example, in one embodiment, the energy source is an electromagnetic energy source. In another embodiment, the energy source is a mechanical energy source.

In embodiments, at least one end of the antenna is attached to at least one spring. The antenna can be a dipole antenna, but other types of antennas can also be employed.

In another aspect, a method of providing spatial diversity in an RFID reader includes pivoting an antenna between a first and second position, transmitting an RF signal to an RFID tag through the antenna, receiving the RF signal from the RFID tag through the antenna, and processing the RF signal using a signal processor.

The method can also include pivoting the antenna between the first and second position at a set rate approximately equal to a read rate of the RFID reader. Preferably, the method includes pivoting the antenna in at least one of a horizontal, vertical, angular and circular direction.

In one embodiment, the method includes applying an energy force to the antenna, and pivoting the antenna in response to the force. Applying the energy force can include generating an electro-magnetic force to pivot the antenna. For example, generating the electromagnetic force can include alternating a magnetism of a wired coil.

In another embodiment, applying the energy force comprises using at least one of a vibration and inertia to pivot the antenna. The method can include attaching at least one end of the antenna to at least one spring. Preferably, the method includes pivoting the antenna in at least one of a horizontal, vertical, angular and circular direction.

In another aspect an RFID reader includes an antenna assembly comprising 1) an antenna to transmit and receive a RF signal and 2) a ground plane operatively coupled to the antenna, the ground plane pivotable at a set rate and distance between a first and second position. The RFID reader also includes a signal processor for processing the RF signal.

In one embodiment, the ground plane is pivotable in at least one of a horizontal, vertical, angular, and circular direction.

Additional features and advantages will be readily apparent from the following detailed description, the accompanying drawings and claims.

BRIEF DESCRIPTION OF THE DRAWINGS

Like reference symbols in the various drawings indicate like elements.

DETAILED DESCRIPTION

The methods and systems described herein are applicable RFID implementations.

Figure 1:
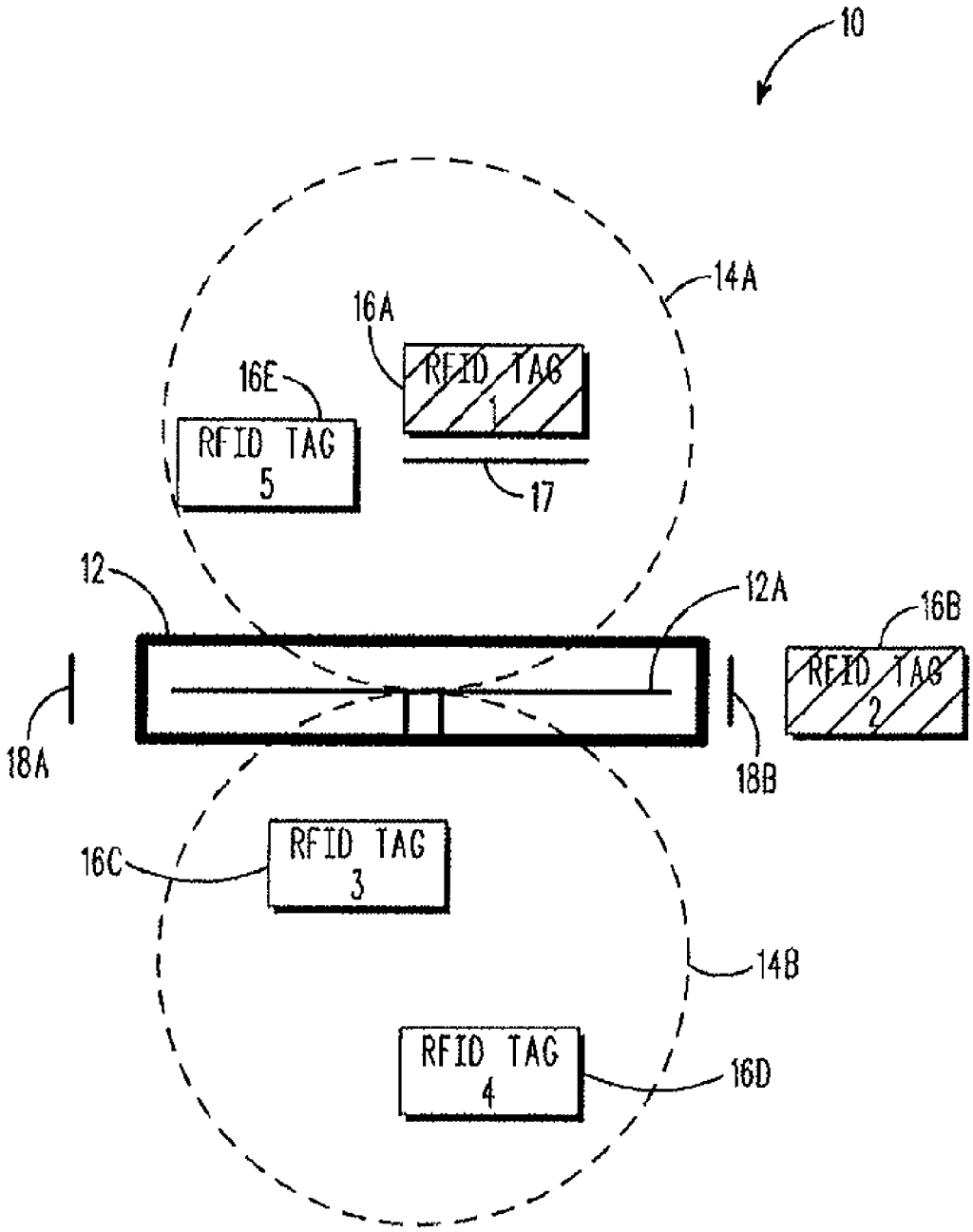
FIG. 1 illustrates a top view of a conventional RFID system including a fixed RFID reader antenna assembly.

FIG. 1 illustrates an environment 10 where an RFID tag reader 12 (also referred to as an "interrogator") attempts communication with an exemplary population of RFID tags 16A-E. Although only five exemplary RFID tags 16A-E are shown in FIG. 1, a population of tags may include any number of tags.

The reader 12 includes a stationary antenna 12A for communicating with tags 16A-E. Antenna 12A radiates a RF signal 14A-B in a geometric pattern of the relative field strengths of the field emitted by the antenna, which are affected by the type of antenna used. For example, in the example shown in FIG. 1, the antenna 12A radiates a RF signal 14A-B in an approximate toroid pattern along a horizontal plane. The antenna 12A of reader 12, however, may be any type of reader antenna known to persons skilled in the relevant art(s), including but not limited to a vertical, dipole, loop, Yagi-Uda, slot, or patch antenna type. Accordingly, radiation patterns of antennas can vary based on the type of antenna employed.

Antenna 12A typically is operatively coupled to a substrate, such as a printed circuit board, which can be operatively coupled to additional electronic components for communicating with tags. Examples of additional electronic components included in the reader 12 of the present invention include an RF transmitter for transmitting the REF signal to the RFID tags 16A-E through the antenna 12A, an RF receiver for receiving the RF signal from the RFID tags 16A-E through the antenna 12A, and a signal processor for processing the RF signal. In some embodiments, the REF transmitter and receiver are combined into a transducer that can be configured in numerous ways to modulate, transmit, receive, and demodulate RFID communication signals through the antenna 12A, as would be known to persons skilled in the relevant art(s). Furthermore, in some embodiments, the substrate also includes a fixed ground plane that operates as a reflector or director for the antenna, which would also be known to persons skilled in the relevant art(s).

In operation, the reader 12 transmits an interrogation signal having a carrier frequency through the antenna 12A to the population of tags 1A-E. Reader 12 typically operates in one or more of the frequency bands allotted for this type of RF communication. For example, frequency bands of 902-928 MHz and 865.6-867.6 MHz have been defined for certain RFID applications.

Various types of tags 16 may be present in tag population that transmit one or more response signals to reader 12, including by alternatively reflecting and absorbing portions of signal according to a time-based pattern or frequency. This technique for alternatively absorbing and reflecting signal is referred to as backscatter modulation. Reader 12 receives and obtains data from response signals, such as an identification number of the responding tag 16. In the embodiments described herein, a reader may be capable of communicating with tags 16 according to any suitable communication protocol, including Class 0, Class 1, EPC Gen 2, other binary traversal protocols and slotted aloha protocols, any other protocols mentioned elsewhere herein, and future communication protocols. Additionally, tag population 16 may include one or more tags having the Packed Object format described herein and/or one or more tags not using the Packed Object format (e.g., standard ISO tags).

FIG. 1 illustrates a common problem associated with interrogating RFID tags. The problem is related to the existence of environmental 17 and antenna 18A-B nulls. Nulls are dead areas in the radiation pattern of an antenna. Antenna nulls 18A-B typically arise in the direction in which an antenna points. Environmental nulls 17 typically arise when an object interferes with the radiation pattern of antenna. For example, as shown in FIG. 1, the reader 12 with the stationary antenna 12A can not read RFID tag-1 16A due to the environmental null 17 and can not read another RFID tag-2 16B due to the antenna null 183. Accordingly, RFID tags 16A-B can not receive or transmit RF signals to or from the reader 12.

Figure 2:
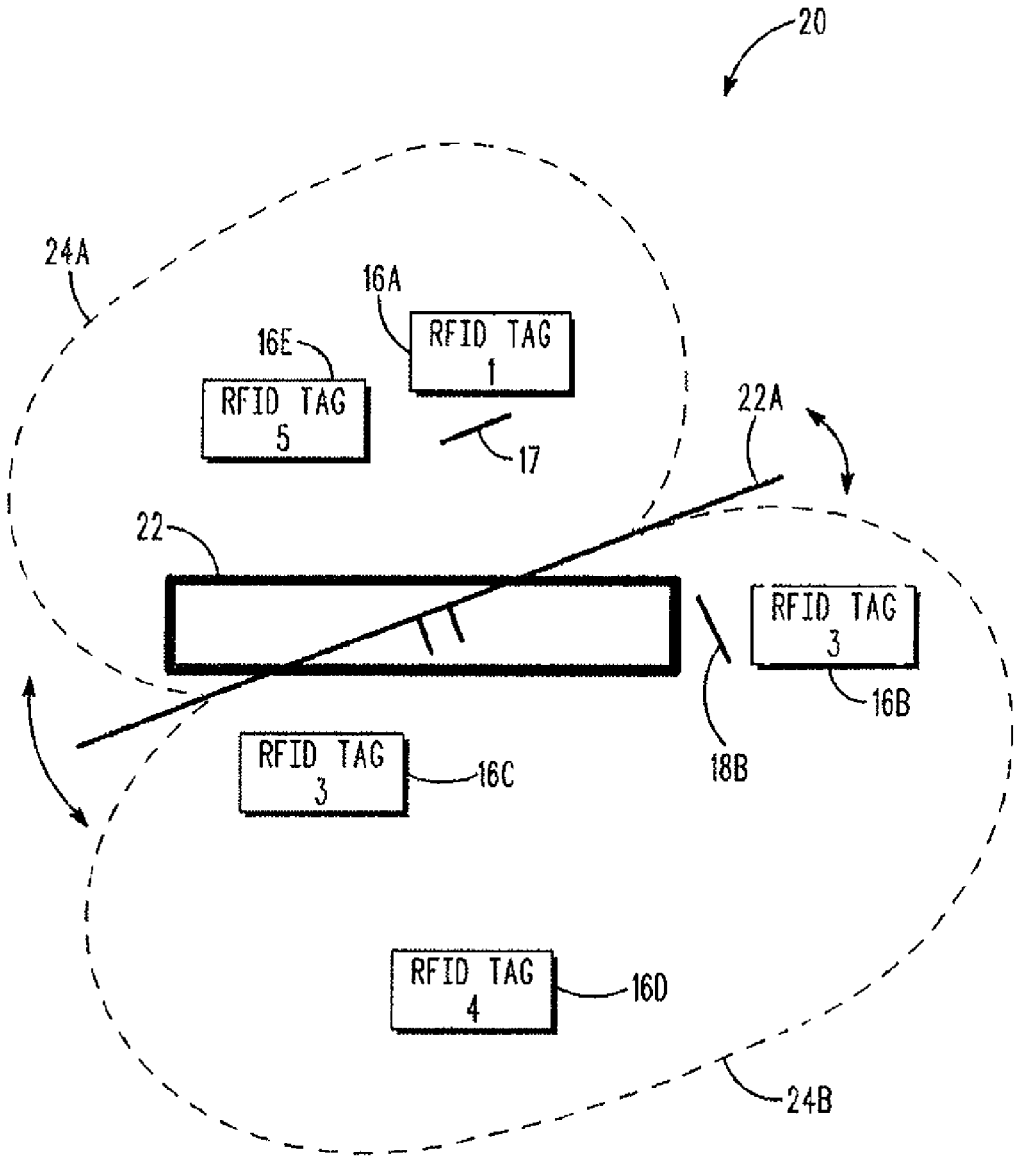
FIG. 2 illustrates a top view of an RFID system according to the present invention.

Turning now to FIG. 2, a top view of an RFID system according to the present invention is disclosed. As shown in FIG. 2, in one embodiment, an RFID reader 22 is provided that includes an antenna 22 pivotable at a set rate and distance between a first and second position. As such, radiation patterns 24A, 24B generated by the antenna 22A can move around antenna and environmental nulls and are non-stationary. In the example shown in FIG. 2, antenna 22A is configured to pivot a pre-defined distance in a horizontal direction, which negates the environmental null 17 impacting the link between RFID Tag-1 16A and the reader 22. Pivoting of the antenna 22A also moves RFID-Tag-2 16B out of the antenna null 18B and into the active antenna pattern 24B. Preferably, the antenna 22A pivots at a rate approximately equal to a read rate for the reader 22.

Figure 3A:
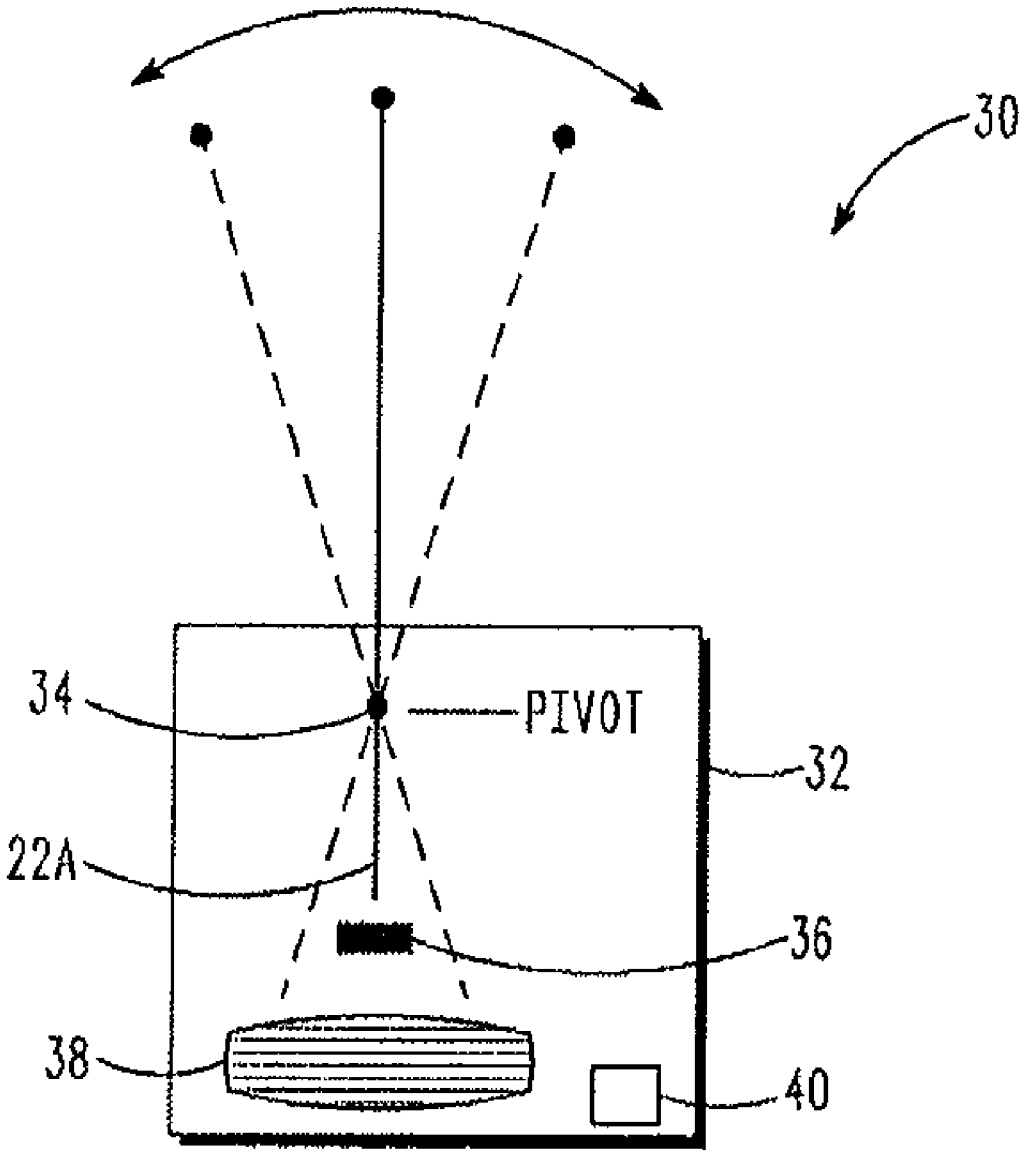
FIGS. 3A-3B illustrate top views of a first and second antenna assembly according to the preset invention.

Referring now to FIG. 3A, a top view of a first antenna assembly 30 included in the RFID reader 22 shown in FIG. 2 is disclosed. As shown in FIG. 3A, in one embodiment, the assembly 30 includes an antenna 22A coupled to a first side of a substrate 32, such as a printed circuit board (PCB), at a pivot point 34. The antenna 22 is made of a metal conductive material (for example, copper or iron). In one embodiment, the antenna 22A is associated with an antenna mount fitted to include a permanent magnet 36. An electromechanical coil 38 is also provided on the substrate 32 which is in electrical communication with an energy source, such as a DC electrical current.

The electro-magnetic coil 38 operates under the control of an RF switch, such as a PIN diode, a GaAs PET, or virtually any other type of RF switching device, as is well known in the art. For example, as shown in FIG. 3A, in one embodiment, a series of control signals are used to bias a PIN diode 40. With the PIN diode 40 forward biased and conducting a DC current, the coil 38 is electrically energized to generate a magnetic field having a same polarity as that emanating from the permanent magnet 36 associated with the antenna 22A, causing the antenna 22A to pivot about the pivot point 34 to a first position in a forward direction relative to the substrate 32. Upon the PIN diode 40 being reverse biased and conducting a DC current, the magnetic polarity of the coil 38 is reversed generating a magnetic field having a different polarity than that emanating from the permanent magnet 36, causing the antenna 22A to be pivoted to the second position in a forward direction relative to the substrate 32.

In one embodiment, the substrate 32 also includes a ground plane that can provide a directional radiation pattern.

Figure 3B:
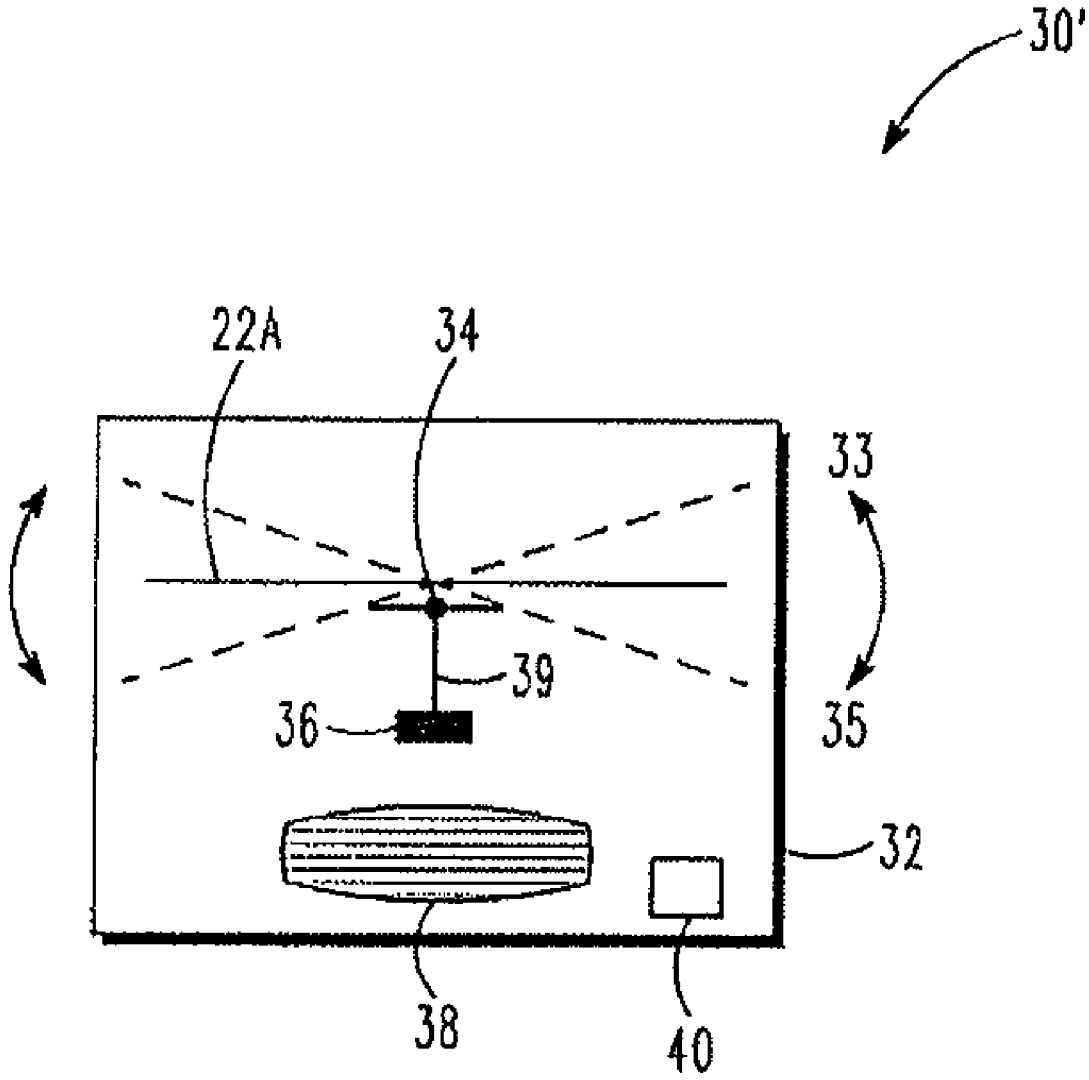

Referring now to FIG. 3B, a top view of a second antenna assembly 30' that can be included in the RFID reader 22 shown in FIG. 2 is disclosed. Similar to the first antenna assembly 30 shown in connection with FIG. 3A, the second assembly 30' includes an antenna 22A coupled to a first side of a substrate 32. As shown in FIG. 3B, however, the antenna 22A is mounted to the substrate at a pivot point 34 that allows the antenna 22A to be pivoted between a first side position 33 and a second side position 35 relative to the substrate 32.

As shown in FIG. 3B, an antenna holder 39 is provided that at one end includes a permanent magnet 36. Similar to the assembly shown in FIG. 3A, an electro-mechanical coil 38 is also provided on the substrate 32 which is in electrical communication with an energy source.

In operation, the electro-magnetic coil 38 functions similarly as that described in connection with FIG. 3A. For example, upon the coil 38 being forward biased and conducting a DC current, the coil 38 generates a magnetic field having a same polarity as that of the permanent magnet 36 causing the antenna 22A to pivot about the pivot point 34 to the first side position 33. Upon the coil 38 being reverse biased and conducting a DC current, the magnetic polarity of the coil 38 is reversed generating a magnetic field having a different polarity than that emanating from the permanent magnet 36, causing the antenna 22A to be pivoted to the second side position.

Figure 4:
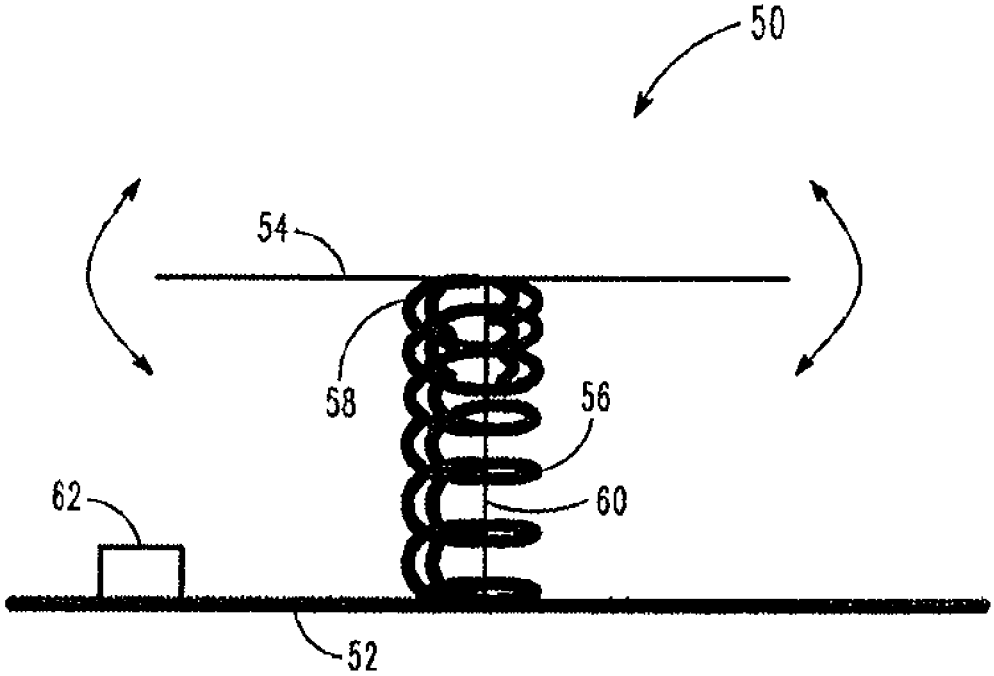
FIG. 4 illustrates a side view of a third antenna assembly according to the present invention.

Turning now to FIG. 4, a side view of a third antenna assembly 50 according to the present invention is disclosed. As shown in FIG. 4, in one exemplary embodiment, the assembly 50 includes a single dipole antenna 54 vertically disposed above a ground plane 52. The antenna 54 is preferably formed from a flexible conductive material and is fed by a single RF feed 60. In one embodiment, the RF feed 60 is terminated away from the ground plane 52 with a female type TNC connector (not shown), however, it should be understood that other connector types could be used. A quarter-wave sleeved balun 62 also is provided on the substrate 32.

As shown in FIG. 4, in one embodiment, antenna 54 is attached to one or more spring 56 at an antenna pivot point 58. Spring 56 operates to pivot antenna 54 between a first and second position based upon movement of the reader. For example, in one embodiment, upon the ground plane 52 receiving a vibration, spring 56 transfers the vibration energy to the antenna 54 at the pivot point 58 resulting in antenna 54 alternately flexing between the first and second positions. Advantageously, by positioning the antenna assembly 50 on a mobile device, vibration energy received from operation of the device results in the antenna 54 pivoting about the pivot point 58, thus spatial diversity can be achieved with a single antenna. It should be understood that other types of mechanical energy can also be used to pivot antenna elements which fall within the scope of the present claims and disclosure.

Figure 5:
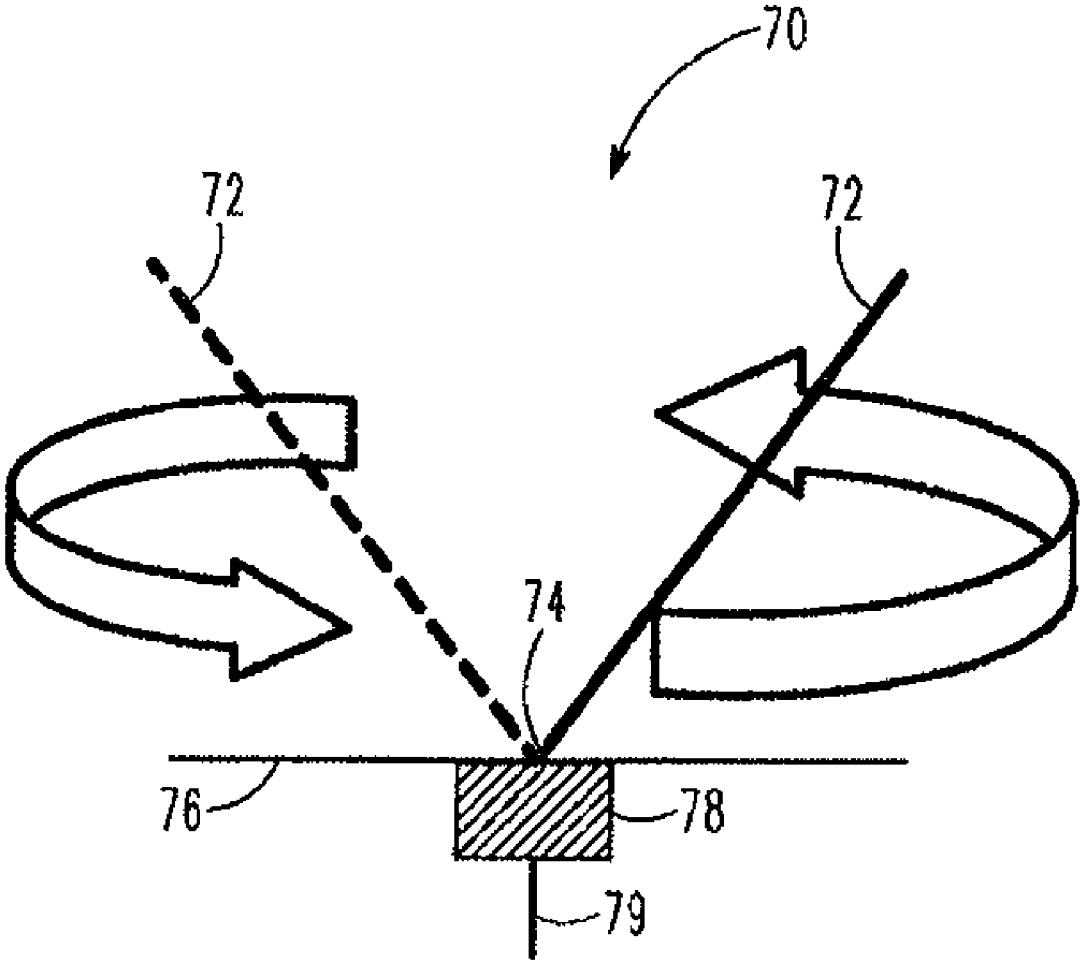
FIG. 5 illustrates a side view of a fourth antenna assembly according to the present invention.

Turning now to FIG. 5, a side view of a fourth antenna assembly 70 according to the present invention is disclosed. Antenna 72 here is a monopole antenna that provides polarization diversity. As shown in FIG. 5, antenna 72 of the assembly 70 is attached at a pivot location to a motor 78 and RF feed 79. Motor 78 can be any conventional motor. In one embodiment, the motor 78 is configured to pivot antenna 72 in a 360° degree circle at approximately a 45° degree angle enabling reading of tags in either horizontal or vertical orientation.

Advantageously, by pivoting the direction of the antenna described in the present disclosure, the antenna assemblies of the present invention provide polarization diversity.

Figure 6:
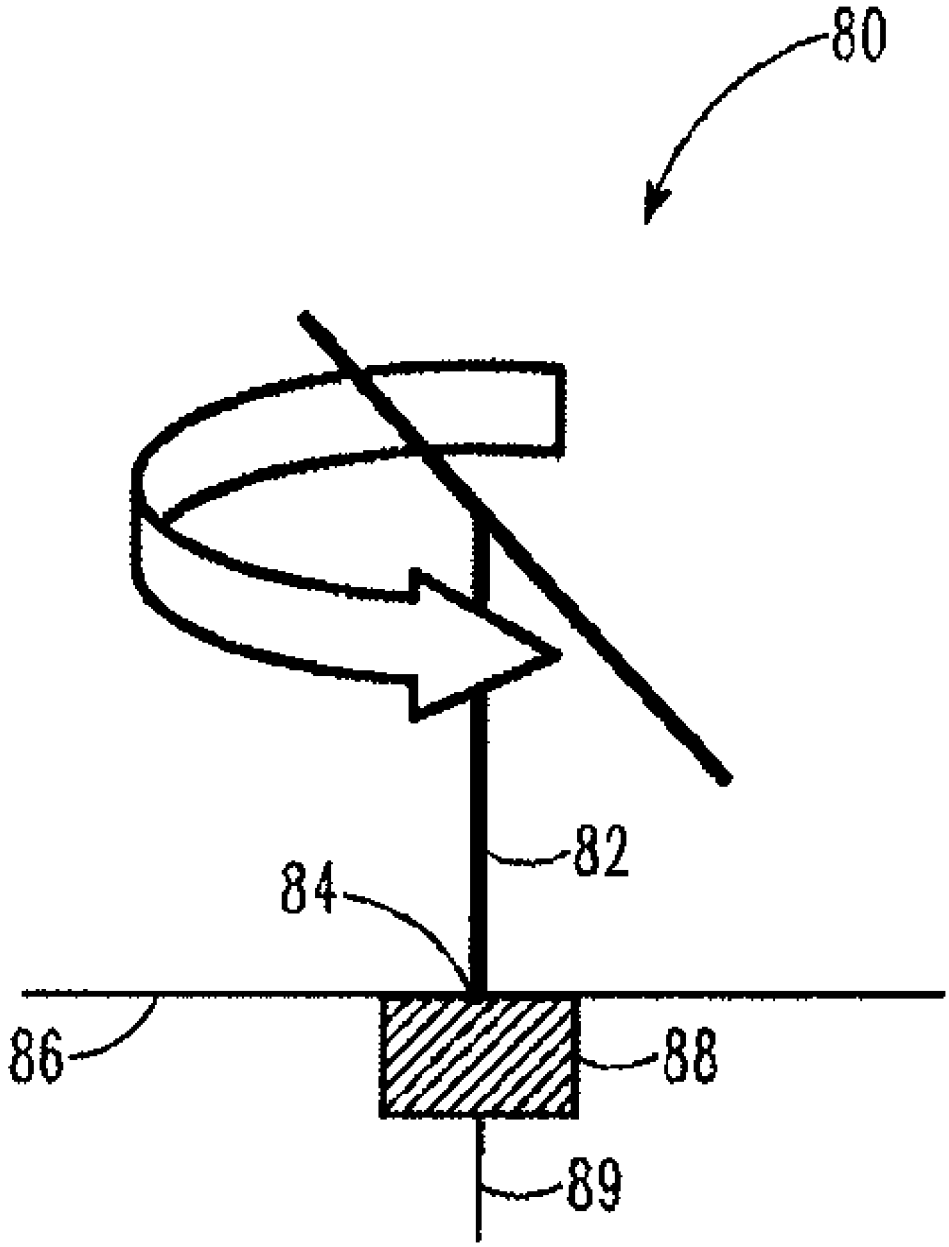
FIG. 6 illustrates a side view of a fifth antenna assembly according to the present invention.

Referring now to FIG. 6, a side view of a fifth antenna assembly 80 according to the present invention is disclosed. Antenna 82 here is a single dipole antenna disposed vertically above a ground plane 86 and supported by a motor 88 and a feed 89. As shown in FIG. 6, in one embodiment, motor 88 operates to pivot antenna about a pivot point 84 in a 360° degree circle, thus providing an omni-polarized antenna with spatial diversity. The present invention, however, is not limited to a 360° degree circular pivot movement and other degrees of pivot movement can be obtained. For example, in another embodiment, motor 88 operates to pivot the antenna 82 about the pivot point 84 at approximately 180° degrees. In yet another embodiment, motor 88 pivots antenna 82 in an elliptical pattern.

Figure 7:
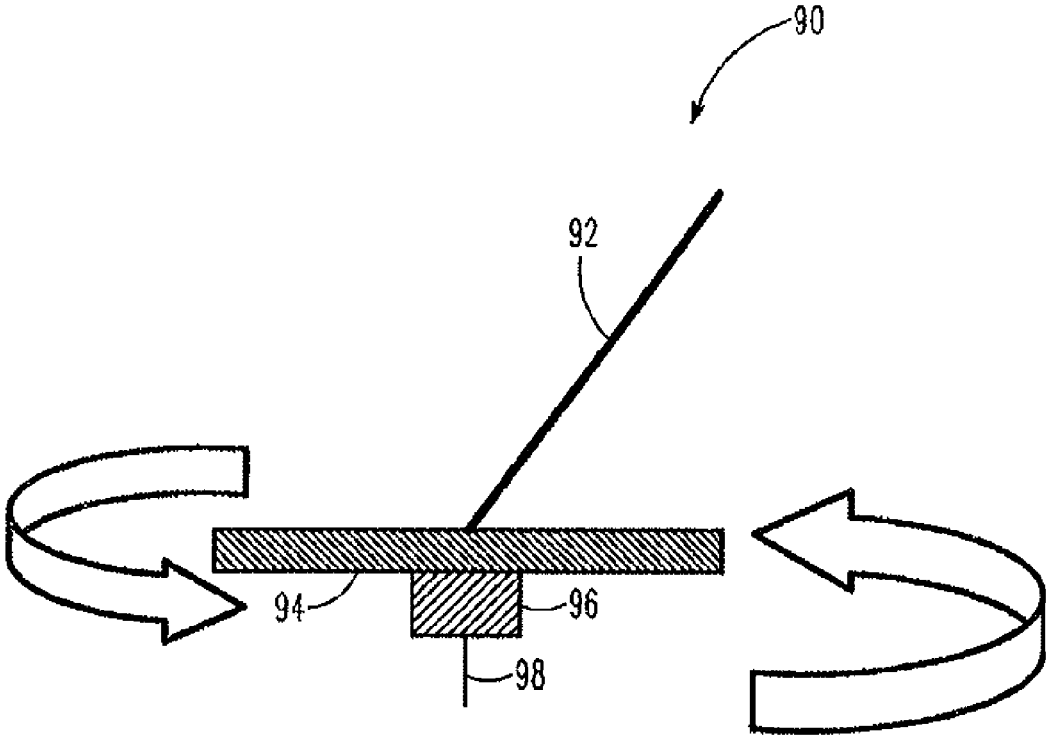
FIG. 7 illustrates a side view of a sixth antenna assembly according to the present invention.

Lastly, referring to FIG. 7, a side view of a sixth antenna assembly 90 of the present invention is disclosed. As shown in FIG. 7, antenna 92 is a single stationary dual dipole antenna 92 that is attached to a ground plane 94. A motor 96 and RF feed 98 are also provided that are operatively coupled to the antenna 92 and ground plane 94, respectively. In one embodiment, the motor 96 is configured to pivot the ground plane 94 between a first and second position. For example, as shown in FIG. 7, in one embodiment, the motor 96 operates to pivot ground plane 94 in a 360° degree circle, thus creating an omni-polarized antenna with spatial diversity. Of course, it will be appreciated by one skilled in the art that motor 96 can pivot ground plane between various degrees and is not limited to a 360° degree circular pivot. For example, in another embodiment, the ground plane is pivoted between 180° degrees. Of course, other degree positions and arrangements of the assembly 90 are contemplated and are within the scope of the present claims.

It will be appreciated that various presently unforeseen or unanticipated alternatives, modifications, variations, or improvements therein may be subsequently made by those skilled in the art which are also intended to be encompassed by the following claims. In addition, the claims can encompass embodiments in hardware, software, or a combination thereof.

What is claimed is:

1. A radio frequency identification (RFID) reader comprising:

an antenna pivotable between a first and second position, the antenna is configured to both transmit and receive a radio frequency (RF) signal;

an RF transmitter for transmitting an RF signal to an RFID tag through the antenna;

an RF receiver for receiving the RF signal from the RFID tag through the antenna; and a signal processor for processing the RF signal;

wherein the antenna pivots at a set rate approximately equal to a read rate of the RFID reader.

2. The RFID reader of claim 1, wherein the antenna is configured to pivot a pre-defined distance.

3. The RFID reader of claim 1, wherein the antenna is pivotable in at least one of a horizontal, vertical, angular, and circular direction.

4. The RFID reader of claim 1, wherein the antenna pivots in response to a change in an energy force.

5. The RFID reader of claim 4, wherein the energy source is an electromagnetic energy source or other motor source.

6. The RFID reader of claim 4, wherein the energy source is a mechanical energy source.

7. The RFID reader of claim 6, wherein the antenna is attached to at least one spring.

8. The RFID reader of claim 1, wherein the antenna is a dipole antenna.

9. A method of providing spatial diversity in a radio frequency identification (RFID) reader comprising:

pivoting an antenna configured for transmitting and receiving a radio frequency (RF) signal between a first and second position, the pivoting performed at a rate approximately equal to a read rate for the RFID reader;

transmitting an RF signal to an RFID tag through the antenna;

receiving the RF signal from the RFID tag through the antenna; and processing the RF signal using a signal processor.

10. The method of claim 9, comprising pivoting the antenna a pre-defined distance.

11. The method of claim 9, comprising pivoting the antenna in at least one of a horizontal, vertical, angular, and circular direction.

12. The method of claim 9, comprising applying an energy force to the antenna; and pivoting the antenna in response to the force.

13. The method of claim 12, wherein applying the energy force comprises generating an electro-magnetic force to pivot the antenna.

14. The method of claim 13, comprising alternating a magnetism of a wired coil.

15. The method of claim 14, wherein applying the energy force comprises using a vibration to pivot the antenna.

16. The method of claim 15, comprising attaching the antenna to at least one spring.

17. The method of claim 9, wherein the antenna is a dipole antenna.

18. A radio frequency identification (RFID) reader comprising:

An antenna assembly comprising 1) an antenna to both transmit and receive a radio frequency (RF) signal and 2) a ground plane operatively coupled to the antenna, the ground plane pivotable at a set rate approximately equal to a read rate of the RFID reader and distance between a first and second position in at least one of a horizontal, vertical, angular, and circular direction; and a signal processor for processing the RF signal.

19. The RFID reader of claim 1, wherein a direction of the first and second position provides polarization diversity of the antenna, and pivoting between the first and second position provides spatial diversity of the antenna.

20. The RFID reader of claim 19, further comprising:

a ground plane operatively coupled to the antenna and configured to provide a directional radiation pattern therefrom.

* * * * *

UNITED STATES PATENT AND TRADEMARK OFFICE

CERTIFICATE OF CORRECTION

PATENT NO. : 8,174,391 B2
APPLICATION NO. : 12/326201
DATED : May 8, 2012
INVENTOR(S) : Sandler et al.

It is certified that error appears in the above-identified patent and that said Letters Patent is hereby corrected as shown below:

In Column 1, Line 14, delete “interrogator”” and insert -- interrogator”, --, therefor.

In Column 3, Line 25, delete “REF” and insert -- RF --, therefor.

In Column 3, Line 29, delete “REF” and insert -- RF --, therefor.

In Column 3, Line 40, delete “tags 1A-E.” and insert -- tags 16A-E. --, therefor.

In Column 4, Line 5, delete “183.” and insert -- 18B. --, therefor.

In Column 4, Line 36, delete “PET,” and insert -- FET, --, therefor.

Signed and Sealed this
Eighth Day of January, 2013

David J. Kappos

David J. Kappos
*Director of the United States Patent and Trademark Office*